US005213305A

United States Patent [19]

Whiteside et al.

[11] Patent Number: 5,213,305

[45] Date of Patent: May 25, 1993

[54] BYPASS ORIFICE FILTER FOR FLUSH VALVE DIAPHRAGM

[75] Inventors: John F. Whiteside, Franklin Park; Bradley S. Richardson, Chicago, both of Ill.

[73] Assignee: Sloan Valve Company, Franklin Park, Ill.

[21] Appl. No.: 867,444

[22] Filed: Apr. 13, 1992

[51] Int. Cl.[5] ..... F16K 31/145; F16K 31/60

[52] U.S. Cl. ..... 251/40; 137/550; 138/41; 138/44; 210/418; 210/497.01; 251/45; 251/120

[58] Field of Search ..... 251/38, 39, 40, 41, 251/42, 45, 118, 120; 138/40, 41, 44, 45, 46; 137/545, 550; 210/418, 497.01

[56] References Cited

U.S. PATENT DOCUMENTS

| | | | |
|---|---|---|---|
| 1,345,946 | 7/1920 | Mueller | 210/497.01 |
| 2,622,739 | 12/1952 | Nilsson | 210/418 |
| 2,776,812 | 1/1957 | Colendar | 251/40 |
| 2,916,251 | 12/1959 | Butts | 251/40 |
| 4,182,414 | 1/1980 | Sanders et al. | 210/497.01 |
| 4,327,891 | 5/1982 | Allen et al. | 251/40 |
| 4,693,817 | 9/1987 | Goldman et al. | 210/497.01 |
| 5,102,541 | 4/1992 | Breitbach | 210/497.01 |

*Primary Examiner*—George L. Walton

*Attorney, Agent, or Firm*—Kinzer, Plyer, Dorn, McEachran & Jambor

[57] ABSTRACT

A bypass orifice and filter for use in the diaphragm of a toilet room flush valve includes an orifice member adapted to be mounted in the flush valve diaphragm, and a filter element attached to the upstream side of the orifice member. The orifice member has a metering restriction to limit the flow of water therethrough and the filter element has a plurality of openings therein in communication with the orifice member metering restriction. The smallest dimension of the openings in the filter element are less than the smallest dimension of the metering restriction so that any particle in the water passing through the filter element will pass through the metering orifice. In some embodiments the orifice member and filter element are an integral unit.

13 Claims, 2 Drawing Sheets

Fig. 7.
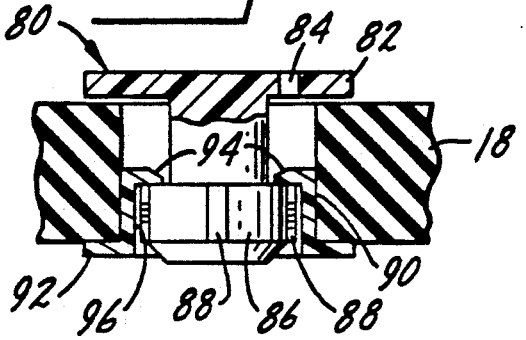
Fig. 9.
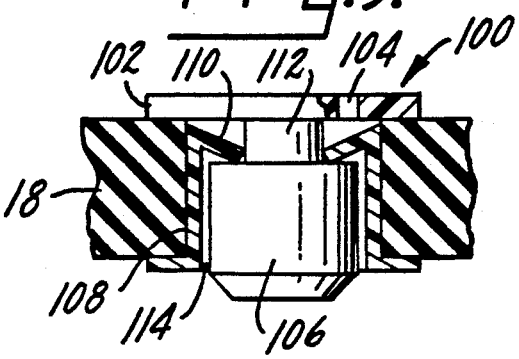
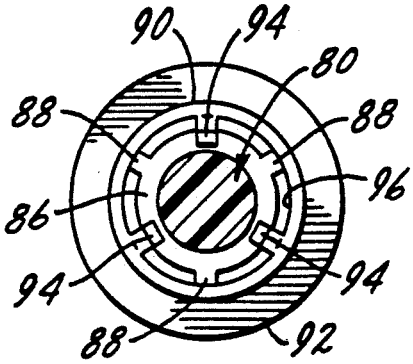
Fig. 8.
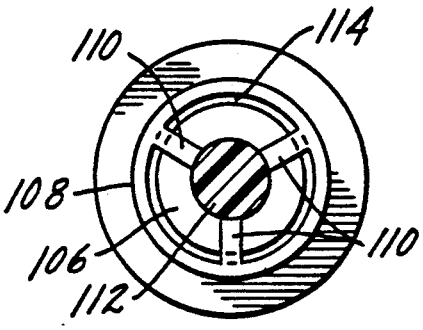
Fig. 10.
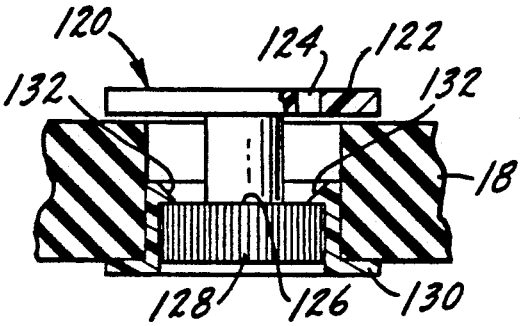
Fig. 11.
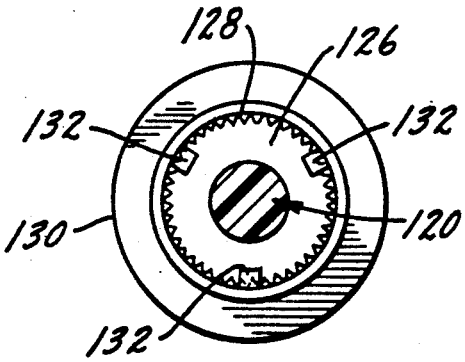
Fig. 12.

BYPASS ORIFICE FILTER FOR FLUSH VALVE DIAPHRAGM

FIELD OF THE INVENTION

The present invention relates to diaphragm-type flush valves for use in a toilet room on either a commode or a urinal, and particularly to the bypass orifice and filter used to control the flow of water from the flush valve inlet to the chamber above the diaphragm. Specifically, the present invention relates to a filter which may be attached to the orifice member and which has a plurality of openings, each of which is smaller in its minor dimension than the metering restriction in the orifice member so that any particle that passes through the filter will also pass through the metering orifice.

THE RELATED PRIOR ART

U.S. Pat. No. 3,656,499, owned by Sloan Valve Company of Franklin Park, Ill., the assignee of the present application, shows a diaphragm-type flush valve having a bypass orifice in the flush valve diaphragm. This product is sold by Sloan Valve Company under the trademark ROYAL.

U.S. Pat. No. 4,261,545, also owned by Sloan Valve Company, shows a piston-type flush valve and a bypass orifice and filter for such a flush valve. This product is sold by Sloan Valve Company under the trademark CROWN.

SUMMARY OF THE INVENTION

The present invention relates to flush valves of the type found in a toilet room on either a commode or urinal and more specifically to a bypass orifice filter for use in a diaphragm-type flush valve.

A primary purpose of the invention is to provide a bypass orifice and filter in which the openings in the filter are individually smaller than the restriction in the bypass orifice to prevent the orifice from clogging due to particles within the water.

Another purpose is to provide a bypass orifice of the type described in which the metering restriction in the orifice member may be of varying size depending upon the desired amount of water flow through the flush valve during each operation thereof.

Another purpose is a bypass orifice filter for the use described in which the filter prevents clogging of the bypass orifice metering restriction.

Other purposes will appear in the ensuing specification, drawings and claims.

DESCRIPTION OF THE PREFERRED EMBODIMENT

The invention is illustrated diagrammatically in the following drawings wherein:

FIG. 7 is a side view, in part section, showing a second embodiment of the invention;

FIG. 8 is a top section of the filter element and orifice member of FIG. 7;

FIG. 9 is a side view of a third embodiment of the invention;

FIG. 10 is a top section of the filter element and orifice member of FIG. 9;

FIG. 11 is side view, in part section, of a fourth embodiment of the invention; and FIG. 12 is a top section of the filter element and orifice member of FIG. 11;

DESCRIPTION OF THE PREFERRED EMBODIMENT

Figure 1:
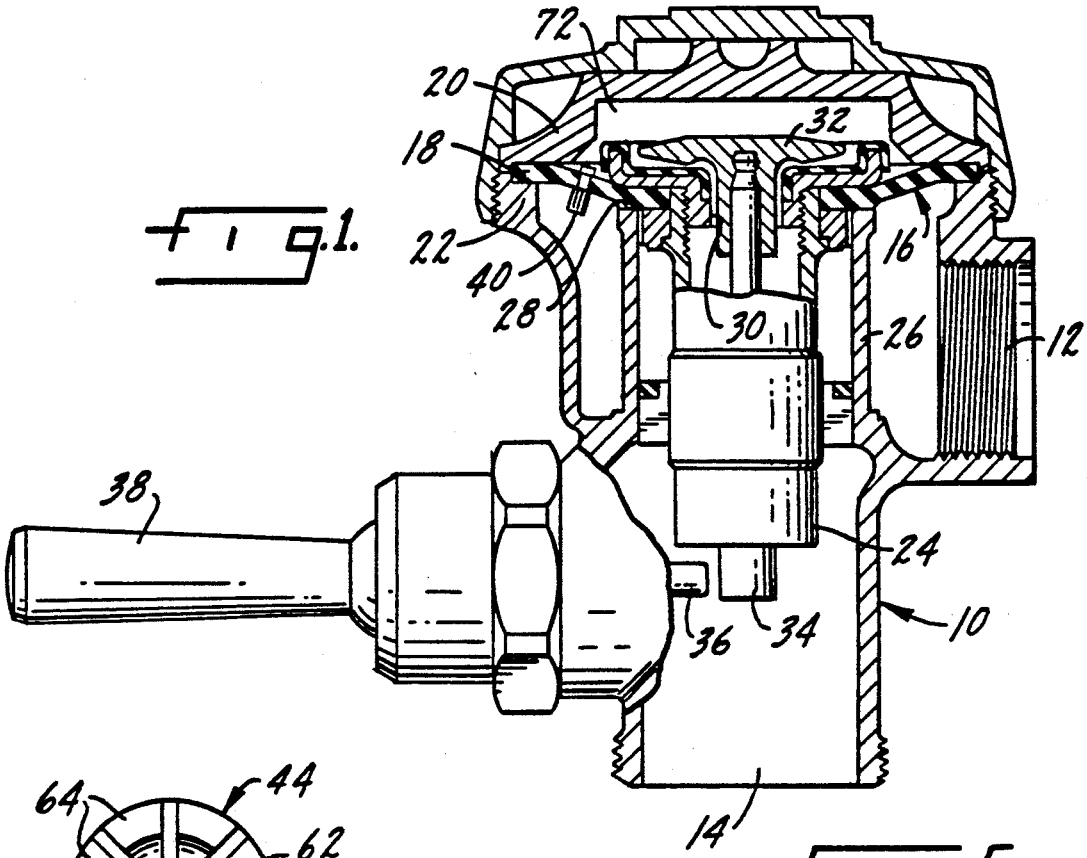
FIG. 1 is a side view, in part section, of a diaphragm-type flush valve.

Sloan Valve Company of Franklin Park, Ill., assignee of the present application, manufactures and sells a diaphragm-type flush valve under the trademark ROYAL. This is the most widely used flush valve for commercial toilet rooms in the United States. A diaphragm-type flush valve requires a bypass to connect the water inlet with the chamber above the flush valve diaphragm, as pressure in this chamber is what causes the diaphragm to move to its valve closing position. The present invention provides a combination bypass orifice and filter, with the filter having openings therein sized to prevent clogging of the metering restriction in the bypass orifice.

In the drawings, the flush valve body is indicated generally at 10 and has a water inlet 12 and a water outlet 14. The flush valve has a diaphragm assembly 16 which includes a flexible diaphragm 18 clamped about its periphery between an internal cover 20 and a shoulder 22 formed in the flush valve body 10. A guide member 24 is attached to the diaphragm and extends within a barrel 26 of the flush valve, the barrel forming a passage between the inlet and the outlet. At the top of the barrel there is a seat 28 upon which the diaphragm assembly closes.

The diaphragm is provided with a central opening 30 within which is positioned a relief valve 32, the lower end of which, indicated at 34, is positioned for contact by plunger 36. As is well known in the art, plunger 36 is operated by movement of handle 38. The description and function of the flush valve are more fully described in the above-identified United States patent.

Figure 4:
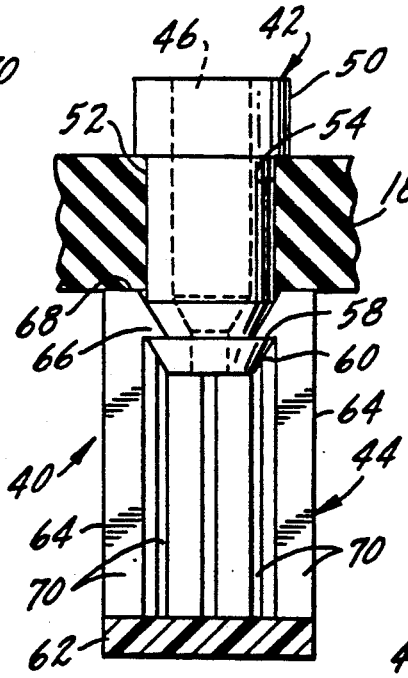
FIG. 4 is a side view, in part section, showing the filter element connected to the orifice member.
Figure 5:
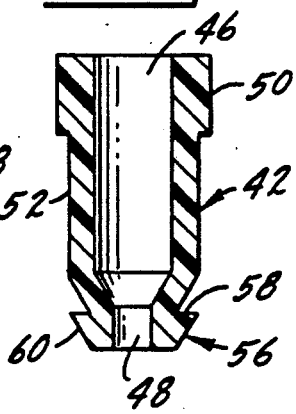
FIG. 5 is an axial section through the orifice member.
Figure 6:
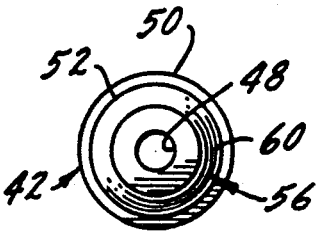
FIG. 6 is a bottom view of the orifice member of FIG. 5.

A bypass orifice and filter element is indicated generally at 40 in FIG. 1 and is formed of two separate parts. There is an orifice member 42 and a filter element 44. Orifice member 42 has a central passage 46 terminating in a metering orifice 48 at its upstream end. The exterior of orifice member 42 has a shoulder 50 which is positioned on top of diaphragm 18 when the orifice member is mounted therein. Note particularly FIG. 4. A cylindrical outer portion 52 of the orifice member fits within an opening 54 in the diaphragm and the orifice member has a tapered end section 56 which cooperates with mating portions of the filter element for attachment of the two parts. There is an annular tapered recess 58 on the orifice member which is just above a slanted or tapered outer surface 60.

The filter element includes a solid bottom 62 and a plurality of upstanding arms 64, each of which terminates in an inwardly-directed hook portion 66. As particularly shown in FIG. 4, to attach the filter element to the orifice member, the flexible arms 64 of the filter element will bend outwardly until the hooks 66 can be positioned within annular recess 58 on the exterior of the orifice member. The two elements are then joined together. Normally, the orifice member will first be positioned within the diaphragm and then the filter element will be attached to the upstream end of the orifice member such that the upper surface 68 of each arm 64 is positioned against the lower surface of diaphragm 18.

Figure 2:
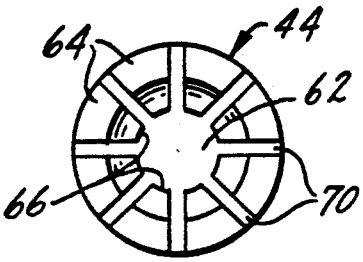
FIG. 2 is a top view of the filter element.
Figure 3:
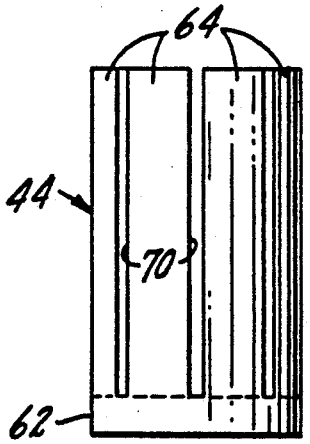
FIG. 3 is a side view of the filter element.

In between each of the axially-extending arms 64 of the filter element there is a gap 70 which extends from the solid bottom 62 of the filter element and terminates at slanted surface 60 of the orifice member. The width of each of the gaps 70, as particularly shown in FIG. 2, is less than the smallest diameter or smallest dimension of the metering restriction 48. Thus, any particles which will pass through the gaps 70 will pass through the metering restriction. The filter, therefore, prevents any clogging of the bypass orifice.

The metering restriction 48 may be of several different sizes, depending upon the desired volume of water used to flush a particular toilet device. The bypass orifice determines the rate at which water flows into the chamber 72 above diaphragm 18 and it is water pressure within this chamber which causes the diaphragm to close on seat 28, thus terminating operation of the flush valve. The faster water flows through this orifice, the quicker the diaphragm will close and the less water will pass through for a particular flushing operation. However, regardless of the size of the metering restriction 48, the smallest dimension of gap 70 will always be less than the metering restriction 48 so that the filter will stop any particle which might otherwise tend to clog the metering restriction.

The gaps 70 provide a substantial passage for the flow of water and thus will not in any sense restrict the flow of water through the bypass orifice. Even if there is a slight clogging of one portion of one of the gaps 70, the total area for water flow is substantially greater than that of the metering restriction 48.

In the embodiment of FIGS. 7 and 8, the bypass orifice and filter are combined into a single element 80 which has an upper flange 82 which overlies the flush valve diaphragm 18. There is an opening 84 in the flange which functions as the bypass orifice. Member 80 has a lower cylindrical section 86 with a plurality of outwardly-extending radial projections 88. The cylindrical portion 86 is centered within the opening in the diaphragm by a retainer 90 having a lower flange 92 which lies against the underside of the diaphragm and an upwardly, inwardly directed group of spaced projections 94 which retain the element 80 in the position shown in FIG. 7. The projections 88 which bear against the inside of retainer 90 maintain concentricity of the cylindrical portion 86 and the space between the cylindrical portion 86 of element 80 and the inside surface 96 of retainer 90, through which water will pass, is smaller in radial dimension than the diameter of bypass orifice 84. Thus, any particle which will pass through the filter comprised of the circumferential spaces between the exterior of cylindrical portion 86 and the inner surface 96 of the retainer will also pass through bypass orifice 84.

In the embodiment of FIGS. 9 and 10, the bypass orifice and filter element 100 has an upper flange 102 which again overlies the flexible diaphragm 18. The orifice is indicated at 104 and the member 100 has a cylindrical portion 106 which will be concentrically spaced within the opening in the diaphragm by a retainer 108. Retainer 108 has a plurality of inwardly-directed projections 110 which will bear against a smaller cylindrical portion 112 of the member 100, thereby retaining member 100 in a concentric position such that the exterior gap between cylindrical portion 106 and the inside surface of retainer 108 is uniform. This space, indicated at 114, will have a smaller radial dimension than the diameter of bypass orifice 104, again so that any particle which will pass through the filter, which is space 114, will also pass through the bypass orifice.

In the embodiment of FIGS. 11 and 12, the combined bypass orifice and filter element is indicated at 120 and includes a flange 122 and a bypass opening 124. There is a cylindrical portion 126 of the member 120 which has an exterior grooved surface, as illustrated particularly in FIG. 12. The grooves 128 may be uniformly arranged about the periphery of the cylindrical portion 126. A retainer 130 having inwardly-directed arms 132 will be used to center the member 120. However, it should be noted that the exterior of cylindrical portion 126 will be in spaced contact with the interior of retainer 30 between each of the spaced grooves 128. Again, the size of the grooves 128 will be such that any particle which would pass through the grooves would also pass through the bypass orifice 124.

Whereas the preferred form of the invention has been shown and described herein, it should be realized that there may be many modifications, substitutions and alterations thereto.

The embodiments of the invention in which an exclusive property are claimed are defined as follows:

1. A bypass orifice and filter means for mounting in a toilet room flushing device including a body, a flange at one end of said body for positioning said body within a water passage in the flushing device, a metering restriction in said flange to limit the flow of water through said bypass orifice and filter means, a plurality of circumferentially arranged uniform filter passage about an upstream portion of said body, with the smallest dimension of each passage being less than the smallest dimension of the metering restriction and means for centering said body within said water passage of said flushing device.

2. The bypass orifice and filter means of claim 1 further characterized in that said filter passages are formed by a plurality of uniformly spaced grooves on the exterior of said body portion.

3. The bypass orifice and filter means of claim 1 further characterized by and including a retainer positioned exteriorly of said body and centering said body within a water passage of said flushing device.

4. The bypass orifice and filter means of claim 3 further characterized in that said filter passages are formed between an interior surface of said retainer and the exterior of said body.

5. The bypass orifice and filter means of claim 4 further characterized in that said body includes a plurality of outwardly-extending projections which center said body within said retainer.

6. The bypass orifice and filter means of claim 4 further characterized in that said retainer includes a plurality of inwardly-extending projections which center said body within said retainer.

7. A bypass orifice and filter for use in a diaphragm of a toilet room flushing device including an orifice member for mounting in the diaphragm, said orifice member having a passage with a metering restriction therein to limit the flow of water through the orifice member, and a filter element attached to the upstream side of said orifice member, said filter element having a plurality of openings therein in communication with said metering restriction, the smallest dimension of each opening being less than the smallest dimension of the metering restriction, so that any particle in the water passing through the filter element openings will pass through the metering restriction, said filter element including a bottom and a plurality of integral flexible arms, each of which is formed and adapted to yieldingly attach to the upstream end of said orifice member, the spaces between said arms forming the openings in said filter element.

8. The bypass orifice and filter of claim 7 further characterized in that said filter element openings are slots extending in an upstream direction from said orifice member.

9. The bypass orifice and filter of claim 8 further characterized in that said orifice member metering restriction is at the upstream end of said passage.

10. The bypass orifice and filter of claim 9 further characterized in that the ends of each of said filter element arms interlock with a projection on the upstream end of said orifice member.

11. A diaphragm assembly for use in a diaphragm-type flush valve including a diaphragm formed of a flexible material and adapted to separate the inlet and outlet of a flush valve, a bypass orifice and filter mounted in said diaphragm and including an orifice member and a filter element attached thereto, said orifice member having a passage with a metering restriction therein to limit the flow of water therethrough, said filter element being attached to the upstream side of said orifice member and having a plurality of openings therein in communication with said metering restriction, the smallest dimension of each opening being less than the smallest dimension of the metering restriction, so that any particle in the water passing through the filter element openings will pass through the metering restriction, said filter element including a bottom and a plurality of integral flexible arms, each of which is formed and adapted to yieldingly attach to the upstream end of said orifice member, the spaces between said arms forming the openings in said filter element.

12. The bypass orifice and filter of claim 11 further characterized in that the ends of each of said filter element arms interlock with a projection on the upstream end of said orifice member.

13. In a flush valve, a body having an inlet and an outlet, a passage connecting the inlet and outlet, a valve seat in said passage, a diaphragm positioned to control the flow of water through said passage and to close upon said seat, a bypass orifice and filter member mounted in said diaphragm, said bypass orifice and filter member including a body, a flange at one end of said body for positioning said body within a passage in said diaphragm, a metering restriction in said flange to limit the flow of water through said bypass orifice and filter member, a plurality of circumferentially arranged uniform filter passages about an upstream portion of said body, with the smallest dimension of each passage being less then the smallest dimension of the metering restriction, and a retainer positioned exteriorly of said body and centering said body within said diaphragm passage.

* * * * *